United States Patent [19]

Gergory

[11] Patent Number: 4,884,311

[45] Date of Patent: Dec. 5, 1989

[54] DENTAL APPLIANCE

[76] Inventor: Harbert S. Gergory, 26 Country Club Park, Covington, La. 70433

[21] Appl. No.: 199,373

[22] Filed: May 27, 1988

[51] Int. Cl.[4] ..... A46B 9/04

[52] U.S. Cl. ..... 15/167.1; 15/168; 15/246; 15/257 R; 15/184; 206/362.2; D4/108; 134/6; 300/21; 128/62 A

[58] Field of Search ..... 15/168, 248 R, 246, 15/257, 184, 167.1; D4/108, 1 B; 206/362.1, 362.2, 362.3, 362.4, 361; 128/62 A

[56] References Cited

U.S. PATENT DOCUMENTS 2,797,886 7/1957 Pinckney ..... 15/184 X
2,897,531 8/1959 Calabrese ..... 15/168 X

FOREIGN PATENT DOCUMENTS 241090 11/1911 Fed. Rep. of Germany ..... 15/168

*Primary Examiner*—Peter Feldman
*Attorney, Agent, or Firm*—Jennings, Carter, Thompson & Veal

[57] ABSTRACT

This invention relates to the field of oral hygiene. One embodiment comprises a spring clamp adapted for removable affixation to the bristles of a toothbrush, after it has been used, in a crucial region proximal the free ends of the brush bristles. A discovery and identification of the crucial area is claimed. A preferred embodiment is so designed that the impact area of the clamp on the brush is approximately ¼ distance down from the free ends of the bristles. The clamp causes the bristles to be closely juxtaposed throughout the clamped area, while the bristles above the clamped area are permitted to flare outward, while the lower portion of the bristles below the clamp line form into a wedge-like configurtation, both of which shapes tend to move in opposite direction during the brushing action providing a resilient base of support for the flared upper portion. The configuration so formed will not substantially retain itself during subsequent use and may be re-formed to those configurations after each use by following the same clamping procedure. Thereby, a soft-bristle toothbrush, which is most desirable for effective orthodenture tooth hygiene, in contrast to the hard bristle brush, may have resilience which enhances its cleaning effectiveness imparted to and retained by it without disarray of the bristles from hard use.

12 Claims, 4 Drawing Sheets

FIG. 9A FIG. 9B FIG. 9C
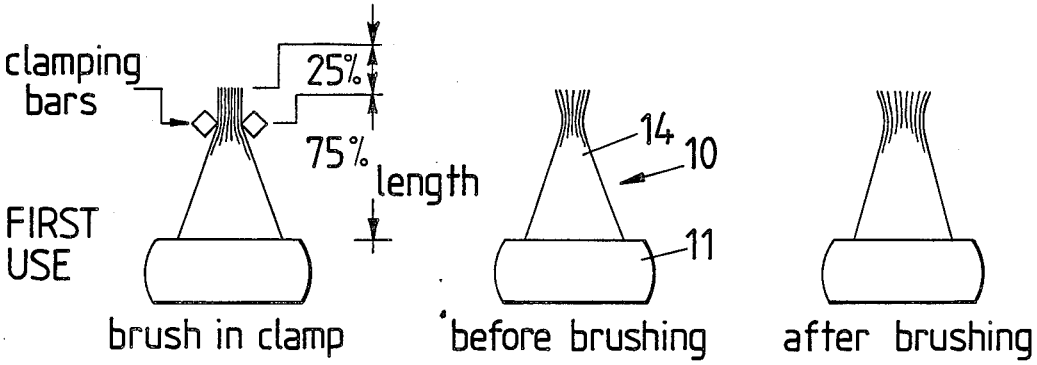
FIG. 9D FIG. 9E FIG. 9F
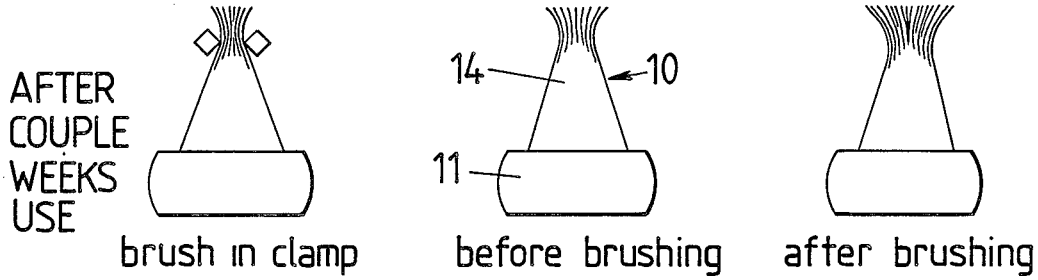
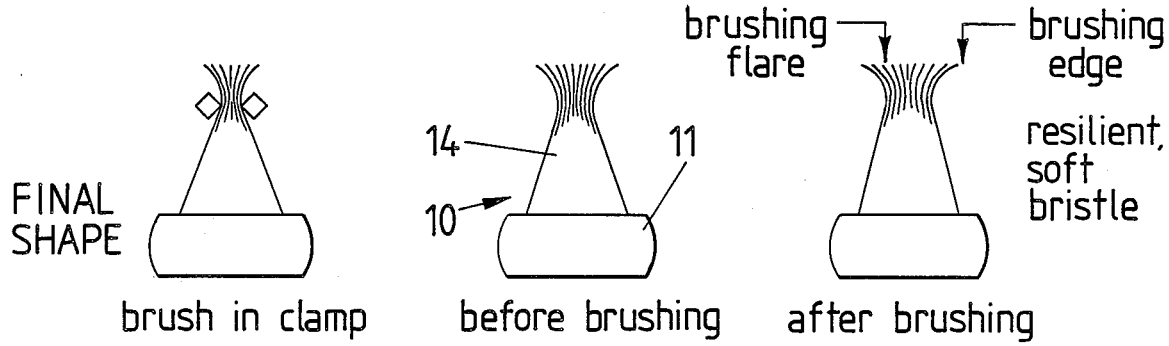
FIG. 9G FIG. 9H FIG. 9I

EDGE BRUSHING brush in vertical orientation

FLARE BRUSHING brush in horizontal orientation

DENTAL APPLIANCE

BACKGROUND OF THE INVENTION

In the field of dental hygiene, it is known that it is advantageous to use a soft-bristle toothbrush for regular home-cleaning regimens. This is particularly true, from the specialized view of the field of periodontistry. That area of dentistry is principally concerned with the physiology and pathology of the gums and other "soft-tissue" of the tooth-bearing region of the mouth, vis-a-vis the teeth themselves and their associated skeletal regions. More particularly, periodontistry is directed toward preventing and correcting the diverse effects of plaque-causing bacteria in the gingival sulcus area under the gum flap which covers the base of the teeth.

In the daily home-practice of oral hygiene, periodontists strongly favor the use of toothbrushes having soft bristles. The reasons for this are to provide a brush which is sufficiently flexible to massage throughly the soft tissues of the mouth, to stimulate blood circulation, and to disorganize bacteria; all without causing undue trauma to the oral tissues. Further, the straight bristles normally used in a conventional brush, are not effective to scour comfortably under the gum flap.

Currently, the bristles in toothbrushes are almost always made from thermo-plastic materials. Inherently, these are easily deformed. Soft bristles, being inherently even more supple and susceptible to bending than "hard" bristles which are thicker and/or made from material which is more rigid structurally, are not useful for any reasonable period of time in the manner which periodontists particularly seek. Such bristles individually spread and bend over and become fixed more or less permanently in a multitude of directions, rather than staying aligned, more or less. Thus, the bristles do not present a coordinated mass of soft bristles to the brushed area. This can render the brush unusable, particularly over any considerable length of time, and even hazardous to the soft tissues in the mouth.

The long, soft, bristles in the presently available designs are, inherently, individually, structurally weak, and readily collapse under pressure. For this reason, brushes are made available in the "medium" and "hard" bristle types so they will stand up better under the pressure of brushing. Yet these are counter-productive because the stiffer bristles have a greater tendency to injure the soft tissues. This tendency to injury increases as the bristles spread with use.

From the foregoing, it may be seen that:

All present brushes become permanently deformed with use and increasingly become unsatisfactory for use.

The basic shape of the present bristle design does not lend itself to reaching the vital sulcus area under the gum flaps.

The soft bristles rapidly become deformed with repeated use and do not present a resilient coordinated mass of soft bristles for brushing action.

The "medium" and "hard" brushes provide increased resilience, when new, but soon take a self-defeating spreading set.

All of the above establishes a need for a brush made of soft bristles which are formed in a manner to substantially increase the effective resilience of the soft bristles, which eliminates the need for the "medium" and "hard" brushes; and which at the same time, produces a maintainable, coordinated mass of soft bristles, so formed that the sulcus area is properly addressed, and all surfaces are comfortably and effectively scoured.

A variety of proposals have been made for straightening brush bristles after use. Some of them contemplate pressing to a limited degree on the free ends of the outer bristles so as to cause them to deflect inwards, so as to make the group of bristles form a uniform mass without edge fraying. In this connection, reference is made to U.S. Pat. No. 271,814; No. 637,522; No. 1,444,677; No. 3,120,019; and No. 3,995,743. However, even these prior art teachings do not produce results desired by periodontists and other such specialists in oral hygiene since, even when practiced with soft bristle brushes, the effect at best is merely to reduce edge-fraying. Consequently, the prior art devices provide no greater remedial effect than is available in any soft toothbrush, even when brand new and unfrayed.

Accordingly, it is an object of this invention to provide a dental appliance having soft bristles formed into close juxtaposition in a unique, crucial region proximal their free ends with the free ends of said bristles flared outward with respect to the region in which they are closely juxtaposed.

Still another object of this invention is to provide a dental appliance in which the resiliency of the tooth-contacting portion of the bristles is enhanced by shape and juxtaposition.

Another object is to provide a dental appliance whose bristles are bent at a crucial point, and the ends are formed into a coordinated mass of soft bristles.

Another object of this invention is to provide a dental appliance whose end bristles are reformed after each use into a unique coordinated mass of soft bristles.

Another object of this invention is to provide such a dental appliance in which the portion of the free ends of said bristles above the crucial pressure area will flare outward with respect to the region in which they are closely juxtaposed.

Another object of the invention is to provide such a dental applicance in which the lower portion of bristles below the crucial bending and pressure area are formed into a wedge-like shape which converges at the pressure point.

Another object of this invention is to identify the location of the crucial pressure area in relation to the length of the bristles, above which point the flare and supporting wedge are not formed, and below which crucial area the application of the knife edge bending pressure causes the bent bristles to splay outward instead of bending inward on themselves.

Another object of this invention is to provide a dental appliance whose flared bristle ends are re-established after each use.

Another object of the invention is to establish the bristles of the dental appliance into a shape that effectively eliminates the need for a "medium" or "hard" brush.

Yet another object of the invention is to provide a dental appliance including apparatus for forming the bristles of an associated toothbrush so that they fulfill at least one of the foregoing objects.

Still another object of this invention is to provide such apparatus in a form which is removably affixable after each use.

Another object is to apply all of the above to any soft bristle brush in which an upper, flared, coordinated mass of brush ends are supported by a trained, wedge-like, formation of the coordinated lower mass of bristles so that brushing pressure causes the lower portion of the bristles to bend inward towards each other to gain increased resilient support, rather than to splay outward in individual weakness as in present cases.

SUMMARY OF THE INVENTION

The desired objects may be achieved through practice of this invention, embodiments of which comprise a toothbrush having bristles which are closely juxtaposed to each other in the crucial area in the region next to their free ends, enabling the said ends to be splayed outward while the supporting bristles are trained inward, and methods and complementary apparatus for so forming such bristles wherein the bristles in said region are temporarily clamped at a crucial point into such closely juxtaposed position after each use.

BRIEF DESCRIPTION OF THE DRAWINGS

This invention may be understood from the description which follows and from the accompanying drawings which form a portion of this disclosure and wherein:

FIGS. 9*a-i* represent the progression of bristle training using my invention;

DESCRIPTION OF PREFERRED EMBODIMENTS

Figure 1:
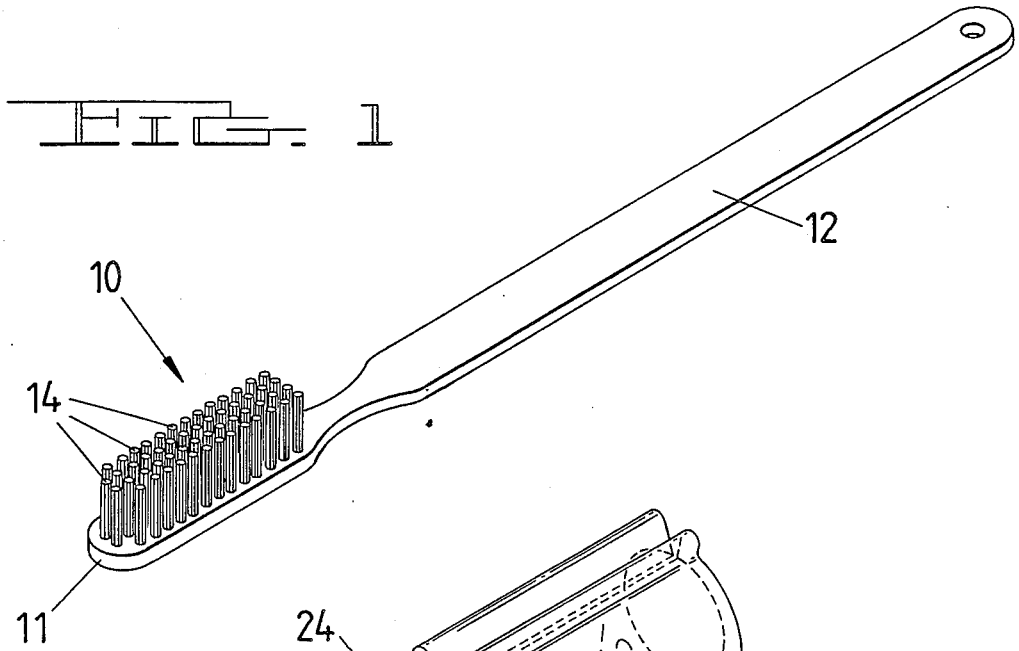
FIG. 1 is a perspective view of an unmodified toothbrush which may be used in the practice of the present invention.
Figure 2:
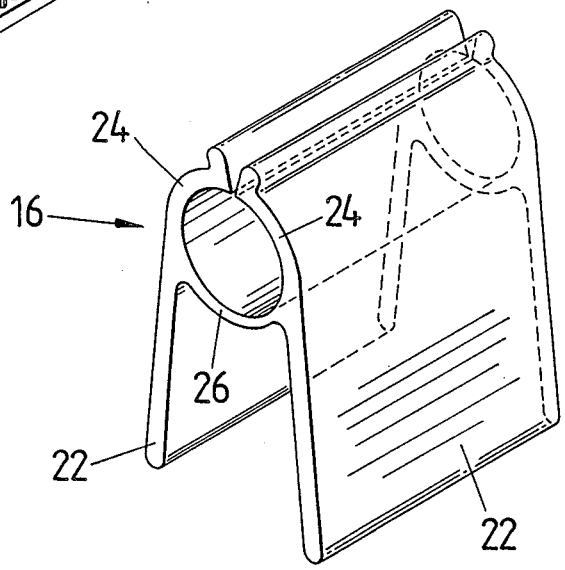
FIG. 2 is a perspective view of a complementarily designed bristle former apparatus useful in carrying out the present invention.
Figure 6:
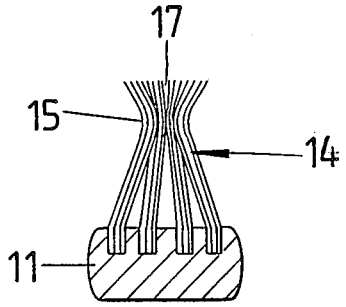
FIG. 6 is a cross-sectional view of the brush shown in FIG. 5 after its bristles have naturally opened into the desired relationship in response to the brushing action.
Figure 7:
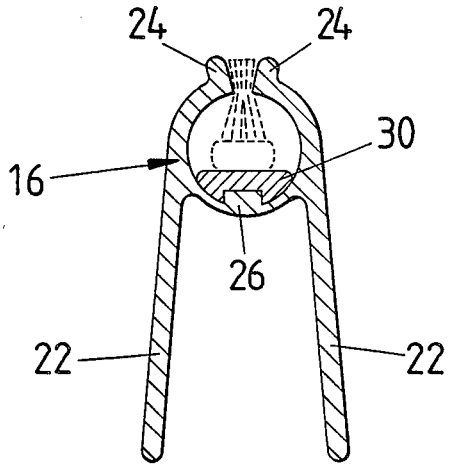
FIG. 7 is a cross-sectional view of another embodiment of this invention.
Figure 8:
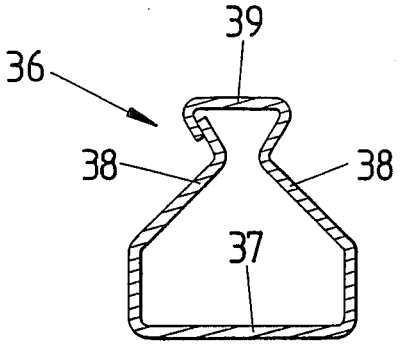
FIG. 8 is a cross-sectional view of another embodiment of this invention.
Figure 10A:
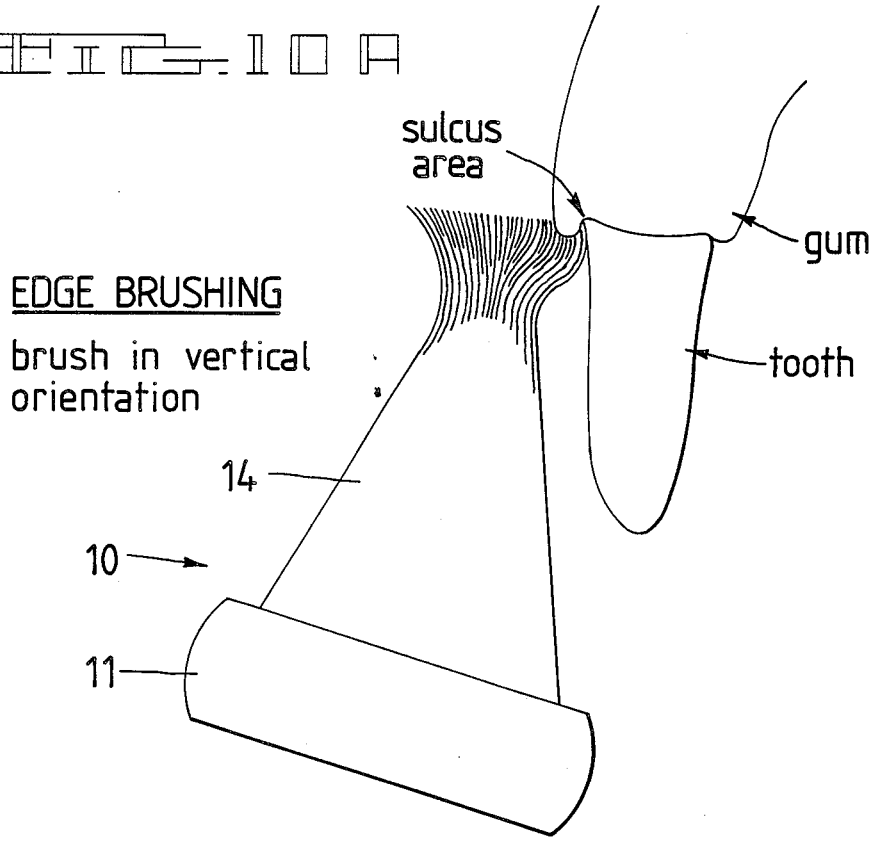
FIGS. 10*a* and *b* show use of the brush to reach the sulcus region.
Figure 10B:
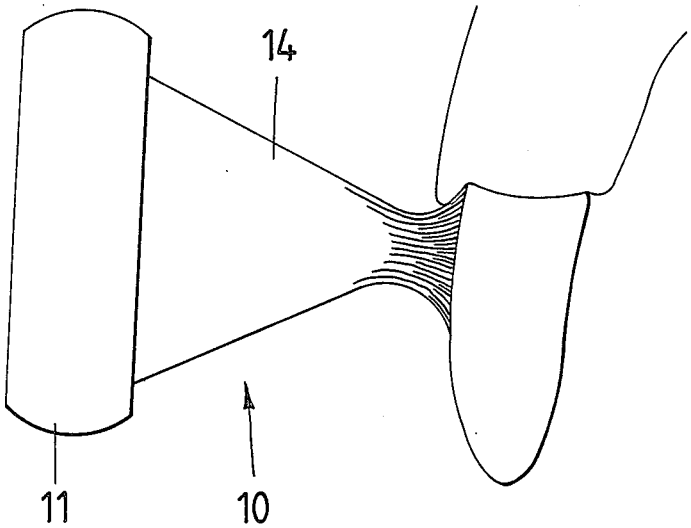

Referring first to FIG. 1, there is depicted a toothbrush 10 having a handle portion 12, one bristle holding end 11, and bristles 14, all of known per se construction. Typically, the handle and bristle holding portion of the toothbrush, as well as the bristles themselves, are made of thermoplastic, because the characteristic of softness in the bristles imparts to them the highly desirable ability to massage the gum tissues, improve blood circulation in the oral tissues, and dislodge bacteria so as to prevent plaque without causing undue trauma to the softer tissues in the mouth. However, the characteristic of softness causes the bristles to bend very easily in many directions upon use. The bristles 14 are not sufficiently resilient to recover from such bending. Thus, after relatively few uses, the brush is no longer capable of performing its desired functions. My invention advantageously utilizes the tendency of the bristles to splay outwardly by compressing them at a crucial point with a clamp 16 so that they are in close juxtaposition in the region 15 proximal their free ends, preferably about ¼ of the distance from the bristle ends 17. This causes the lower portion of the bristles, next to the holding end 11, to be formed into a wedge-shaped mass which provides support and resiliency to the bristle ends 17. When the clamp 16 is removed and brush utilized, the bristles being unrestrained, exhibit "memory" flexion towards being straight, causing the previously clamped region to open slightly. However, the bristle ends 17 stay bent at substantially the same angle with respect to the main body of the bristles, thus the bristle ends flare outwardly, enhancing their effectiveness in removing material from tooth surfaces under the gum flaps. The specific configuration may be seen in FIGS. 4, 5, and 6, hereinafter discussed. Complementary apparatus useful to achieve that purpose is shown in FIGS. 2 and 7–8 inclusive. The clamp apparatus 16 shown in FIG. 2 comprises handles 22, closure jaws 24 to impinge in the crucial area upon the outside of the bristles in a toothbrush, and a spring member 26 to impart bias to the jaws 24 toward closure against opening moments of force imparted to them when the handles 22 are squeezed together. As such, it may be made from a variety of suitable known per se materials, such as plastic or metal, or in combinations of materials, such as plastic elements and metal spring members.

In a preferred embodiment, the entire structure is formed from plastic such as poly-chromate as a single molding having closure jaws 24, at the opposite end of a continuum from handles 22, and separated by a flexible cross bar 26, as shown in FIG. 2. By this means, the jaws 24 are biased against opening in response to squeezing together of the handles 22 by their structural integration with the cross bar 26 and the resulting flexure of the cross bar 26.

It has been found satisfactory if such a clamp is made having the following dimensions:

Center (brush holding) aperture = 9/16"
Handle thickness = ⅛"
Jaw thickness = ¼"
Cross bar (spring) thickness = 0.060"
Handle length = 1¾"
Angle of divergence of handles = 10°

However, it is to be noted that the dimensions of the bristle former must exactly complement the specific brush for which it is designed so that the brush is held in place, and knife-edge pressure is applied in the discovered crucial area at approximately the three-quarter-/one-quarter point.

Figure 3:
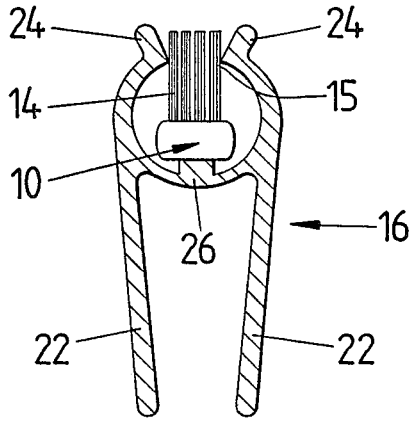
FIG. 3 is a cross-sectional view of the apparatus shown in FIG. 2 with a brush of the type shown in FIG. 1, being used in carrying out the present invention.
Figure 4:
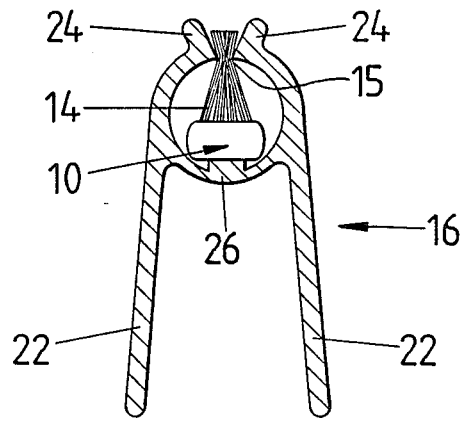
FIG. 4 is a cross-sectional view of the apparatus and brush shown in FIG. 3 in a further step of carrying out the present invention.

FIG. 3 illustrates a toothbrush being received into the brush holding channel of a clamp 16 of the type described above; the clamp handles 22 having been pinched manually to cause them to deflect toward each other and against the clamp closure bias of the spring 26, with resulting opening of the clamp jaws 24. FIG. 4 illustrates the clamp 16 having been released on a brush so positioned, so that the jaws 24 compress the top ends of the bristles in the region 15. This process usually follows use of the brush, when the bristles are still somewhat warm and wet, and at least several hours typically pass before the brush is next put into use, so that in the interim the bristles take on a semi-permanent "set", with the region 15 of the bristles squeezed together in tight juxtaposition and with the main body of the bristles which lies between the compressed region 15 and the bristle end 11 of the brush 10 formed into a wedge which, in cross-section, is substantially an upright triangle. Essentially, the region of compression 15 occurs at about ¼ of the distance down the bristle ends, as this provides a desirable depth for the flared cleaning surface as hereinafter described. It should be noted too that the configuration of the clamp also ensures proper positioning and retention of the brush, so that correct positioning of the clamping action is assured and is maintained.

Figure 5:
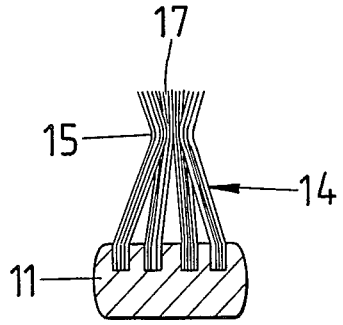
FIG. 5 is a cross-sectional view of a toothbrush of the type shown in FIG. 1 after having been formed by apparatus of the type shown in FIG. 2 in accordance with the teachings of the present invention.

As shown in FIG. 5, the dried bristles of the brush 10, upon removal from the clamp 16, will more or less retain the shape imparted to them while in the clamp. In as much as clamp removal usually occurs immediately before use of the brush, FIG. 5 depict the usual bristle configuration as the brush bristles are presented to the teeth and gums for cleaning.

However, if some time elapses between removal of the clamp and use of the brush, the bristles will tend to become more nearly at right angles to the bristle-holding end of the brush 10 due to memory or the mechanical disarranging of the formed bristle wedge 18 by use itself. Although there may also be some straightening of the bristles in the region 15 where they have been clamped, such straightening is usually not pronounced. Consequently the configuration of the bristles when presented to the teeth and gums while the brush is in use is substantially as shown in FIG. 6. The bristle ends 17 are flared outward, so that in cross-section the group of them forms what may be described as an inverted, truncated triangle, while the wedge-shaped mass 17 may be described as being (in cross-section) a wider based, upright, truncated triangle. The result is that the bristle ends 17 present a very resilient, soft yet orderly, flared array that is ideally suited for cleaning tooth surfaces and for penetration into the sulcus region between the inner surface of the soft gum flaps and the corresponding surfaces of the teeth below the gum line; and the lower supporting wedge of soft bristles bend inward upon themselves providing resilient support to the brushing surface. It follows with proper use of the brush and clamp 16 the desired characteristics of a toothbrush may be retained over long periods, with the same brush being "reconstituted" into the desired configuration described above after each use by simply re-clamping it in clamp 16. Thus, with this invention, it is possible and practical to use soft or extra-soft bristles that otherwise would not provide the resilience or maintain the shape that is essential for continued use. This also eliminates the discomfort that results from the use of a hard bristle brush.

Although the clamp 16 depicted in FIGS. 2–4 and 7 is shown as being substantially circular in cross-section, it may be in any of a wide variety of regular or irregular configurations, or may be a feature of a mounted retainer or portable carrying case.

Since, as noted above, the clamp acts not only as a clamp, but as a positioner to assure that the proper location of the clamping action is assured and maintained, the embodiment of this invention shown in FIG. 7 will be seen to include an adapter 30 which may optionally be added to a clamp 16 of the type heretofore described for the purpose of adapting such a clamp 16 to accommodate smaller sized toothbrushes, such as those used by children. By this means, proper positioning of the bristles of such a toothbrush vis-a-vis the location of the jaws 24 of the clamp 16 in order to carry out this invention may be assured.

FIG. 8 illustrates another clamp 36 which is an embodiment of this invention, in the form of an enclosing cover, made from metal, plastic, or other appropriate material. As such it includes a main body 37 with the upper side walls thereof formed into jaw-like compression surfaces 38, one of which ends with a retaining tab 39, which engages the top of the other side wall such that a brush may be retentively retained with its bristles in the compressive mode hereinabove described.

It is to be noted that the foregoing embodiments of apparatus are illustrative of the various types of structures that might be utilized for these purposes, and that a wide variety of other structures which provide opposing lines of clamping pressure to the free-end region of the brush bristles in the crucial area might be utilized within the contemplation of this invention. As a result of the use of such apparatus on soft-bristle toothbrushes after they have been used for dental hygiene purposes, the end regions of the constituent bristles become set in close juxtaposition as the bristles dry out. It should be further noted that the closure jaw portions, when closed on the bristles of a toothbrush in the region of their free ends which is short of the actual ends themselves, the grouping of bristles may be so re-formed that the area of closest juxtapositioning of the bristles to each other is in the crucial area somewhat below, rather than at, the actual ends of the bristles. The effect of this is to cause the bristles as a group to become re-formed into the configuration shown in FIGS. 2–9 inclusive. As such, a cross-section through the group of bristles taken at right angles to the long axis of the brush handle will be seen to be narrowest (i.e., with the constituent bristles most closely juxtaposed) at about ¼ of the bristle length below the top of the row of bristles, along the lines of contact of the closure jaws with the outside of long sides of the group of bristles. The effect of this, when the clamp is removed and the brush is put into use, is to cause the free ends of the group of bristles to splay outward, so that in cross-section, the group of bristles might be described as resembling somewhat the cross-section of a thistle flower. As such, the brush is rendered especially suited to render extraordinarily effective oral hygiene and cleaning ability. Although of soft texture, which facilitates gum massage and improved circulation, with minimized trauma to the soft tissues of the mouth, the configuration of the brush so modified is particularly adapted, due to the splaying of the group of bristle ends with close juxtapositioning of the bristle in the region immediately adjacent to the bristle ends, to invading the interstice between the gum flap areas and the adjacent tooth walls. The brush thereby is so reformed as to provide superior hygiene and therapeutic effects. After use, which tends to splay the entire length of bristles and not merely their free end and will eventually render the brush substantially unfit for any useful purpose as far as mouth care is concerned, the brush may be re-clamped as previously described, to further enhance and re-establish the re-formation of the previously described. Without the complementary clamp this could not be accomplished.

It is to be understood that the preceding description is by way of illustration and not of limitation, and that other embodiments may be made without departing from the spirit or scope of the invention.

While I have shown my invention in various forms, it will be obvious to those skilled in the art that it is not so limited but is susceptible of various changes and modifications without departing from the spirit thereof.

What I claim is:

1. A dental appliance for oral hygiene comprising an elongated handle portion having a plurality of bristles located at one end thereof extending substantially 90° from the longitudinal axis thereof, said bristles having free ends being soft and resilient and forming a generally rectilinear array along said handle portion; and a detachable means for compressing said bristles transversely of said rectilinear array along a line spaced from the free ends of said bristles, such that the lower portion of said bristles are trained in a wedge-shaped mass with the free ends thereof extending upwardly and outwardly from the longitudinal axis of said handle portion in a flared array suitable for penetration of the sulcus region of a user's gum.

2. A dental appliance as defined in claim 1 wherein said means for compressing includes means for positioning said bristles therewithin such that compressive forces are exerted in a crucial region located 20% to 30% of the length of the bristles from the end thereof.

3. A dental appliance as defined in claim 1 wherein said means for compressing comprises a pair of clamping elements, means for biasing said clamping elements towards one another and means for manually opening said clamping elements for insertion and removal of said handle and bristles.

4. A dental appliance as defined in claim 3 wherein said clamping elements extend over and encapsulate said bristles without applying pressure to the end thereof.

5. A dental appliance as defined in claim 3 wherein said clamping elements are adapted to apply pressure to said bristles along a line generally parallel to said handle portion in the crucial area inwardly of the ends of said bristles.

6. A dental appliance as defined in claim 3 wherein said clamping elements are adapted to apply pressure to said bristles along a line generally parallel to said handle at approximately between 70% and 80% of the bristle length from the handle, such that the free ends of said bristles are not compressed.

7. In a dental appliance comprising an elongated handle portion and a rectangular array of bristles at one end of said handle portion in combination with detachable means for forming said array of bristles into a wedge-like configuration with the free ends of said bristles flaring upwardly and outwardly from the apex of said configuration, such that said bristles retain a wedged and flared configuration upon removal of said detachable means and said flared free ends form a coordinated mass for engaging the sulcus region of the gum.

8. In the dental appliance as defined in claim 7 wherein said detachable means comprising a clamp member for applying pressure to said bristles along a line parallel to said handle and within a predetermined region proximal the free ends thereof.

9. In the dental appliance as defined in claim 8 wherein said clamp has a bore for receiving said handle therewithin and sidewalls for applying pressure to said bristles.

10. In the dental appliance as defined in claim 8 further comprising means for adjusting the depth of said bore such that pressure is applied to said bristles with a predetermined region proximal the free ends thereof, said predetermined region being between about 70% to 80% of the length of the bristle extending from said handle.

11. A method for utilizing a toothbrush wherein the toothbrush bristles assume a desired shape which facilitates hygienic manipulation of the sulcus region comprising the steps of:

(a) applying pressure to the bristles in a predetermined region compressing the bristles in said region to form a lower wedge-shaped mass of bristles and an upper wedge-shaped mass of bristles, said wedge-shaped masses being formed in opposition such that the upper wedge-shaped mass is formed with the free ends of the bristles extending upwardly and outwardly, said free ends defining a flared region adapted for hygienic engagement with the sulcus;

(b) removing the pressure from said toothbrush for normal use in brushing the teeth and the sulcus region of the mouth; and (c) reapplying pressure along said line during the time when said toothbrush is not in use.

12. The method of claim 10 wherein said pressure is applied along a line at between 70% and 80% of the length of the bristles.

* * * * *

UNITED STATES PATENT AND TRADEMARK OFFICE

CERTIFICATE OF CORRECTION

PATENT NO. : 4,884,311

DATED : December 5, 1989

INVENTOR(S) : Harbert S. Gregory

It is certified that error appears in the above-identified patent and that said Letters Patent is hereby corrected as shown below:

On the title page, item [76] should read --Harbert S. Gregory--

[19] should read --Gregory--

Signed and Sealed this

Seventh Day of May, 1991

*Attest:*

HARRY F. MANBECK, JR.

*Attesting Officer*

*Commissioner of Patents and Trademarks*